US007063627B2

(12) United States Patent
Mindlin

(10) Patent No.: US 7,063,627 B2
(45) Date of Patent: Jun. 20, 2006

(54) METHOD AND SYSTEM FOR GOLF INSTRUCTION

(76) Inventor: Richard B. Mindlin, 4101 W. 90th St., Mission, KS (US) 66207-2325

( * ) Notice: Subject to any disclaimer, the term of this patent is extended or adjusted under 35 U.S.C. 154(b) by 0 days.

(21) Appl. No.: 10/999,134

(22) Filed: Nov. 29, 2004

(65) Prior Publication Data

US 2005/0233822 A1 Oct. 20, 2005

Related U.S. Application Data

(63) Continuation-in-part of application No. 10/684,609, filed on Oct. 14, 2003.

(51) Int. Cl.
*A63B 69/36* (2006.01)

(52) U.S. Cl. ..... 473/267; 473/212; 473/218; 473/266

(58) Field of Classification Search ..... 473/207, 473/212–219, 267–276
See application file for complete search history.

(56) References Cited

U.S. PATENT DOCUMENTS

| | | | | | |
|---|---|---|---|---|---|
| 1,484,390 | A * | 2/1924 | Gibbs et al. | ..... | 434/252 |
| 4,000,905 | A * | 1/1977 | Shirhall | ..... | 473/218 |
| 4,164,352 | A * | 8/1979 | O'Brien | ..... | 473/218 |
| 4,563,010 | A * | 1/1986 | McDorman et al. | ..... | 473/267 |
| 4,883,276 | A * | 11/1989 | Brown | ..... | 473/215 |
| 5,163,686 | A * | 11/1992 | Bergman | ..... | 473/218 |
| 5,294,124 | A * | 3/1994 | Florian | ..... | 473/267 |
| 5,303,926 | A * | 4/1994 | Owens et al. | ..... | 473/261 |
| 5,306,011 | A * | 4/1994 | Perry | ..... | 473/218 |
| 5,344,152 | A * | 9/1994 | Brannen | ..... | 473/214 |
| 6,743,111 | B1 * | 6/2004 | Mindlin | ..... | 473/218 |

* cited by examiner

*Primary Examiner*—Nini F. Legesse
(74) *Attorney, Agent, or Firm*—Lathrop & Gage LC

(57) ABSTRACT

A golf instructional system and method is provided for learning proper setup for swinging a golf club, such a system being customizable for an individual golfer by a professional golf instructor. Various embodiments utilize positioning markers, a mirror, an arm wedge, a wand, and an instruction manual.

18 Claims, 5 Drawing Sheets

METHOD AND SYSTEM FOR GOLF INSTRUCTION

RELATED APPLICATIONS

This application is a continuation in part of U.S. patent application Ser. No. 10/684,609 filed Oct. 14, 2003, entitled METHOD AND APPARATUS FOR GOLF INSTRUCTION the disclosure of which is incorporated herein by reference.

BACKGROUND OF THE INVENTION

1. Field of the Invention

This invention relates generally to methods of teaching and systems for improving a golfer's skill and ability, and more specifically, methods and a system useful in determining whether a golfer's golf swing motions are properly executed and for assisting in the muscle memorization process to retain the correct motions needed for properly swinging the golf club.

2. Description of the Related Art

Golf is a sport that has become exceedingly popular all over the world. It is estimated that about two million people in the United States alone take up the game of golf every year. However, about as many people leave the game each year, largely because they are disappointed and frustrated over their inability to improve their golf technique. It is generally believed by leading golf instructors that it is difficult to improve at golf because (a) the essential fundamentals of a good golf swing feel unnatural to our bodies, (b) all natural instincts of students are absolutely wrong, (c) correct habits must be practiced over and over again to develop new and correct habits ("muscle-memory") and (d) while practicing to develop new muscle-memory, students must not be practicing bad habits that result in bad muscle-memory that will eventually have to be unlearned. As generally believed by leading instructors, bad muscle-memory is harder to unlearn than it is to learn good muscle-memory from the start.

To improve their abilities, many golfers take lessons from professional golf instructors. Although such lessons can teach an individual the fundamental skills needed to play the game, these golfers are most often not able to improve their golf club swing as much as desired because of a lack of guidance when practicing outside of the instructional setting. Most often students practicing without an instructor revert to, and practice, what feels natural but is in reality bad technique, thereby developing bad muscle-memory. As an alternative to lessons, self-instruction systems have been developed to allow golfers to improve their game by themselves. This approach has a downside in that such systems must be used in the proper fashion to create positive results, which is often difficult for a beginning golfer or for high handicap golfer who may have already developed bad habits. Further, even if used properly, these systems are often not proven to aid in proper development of a golfer's club swing technique because, as believed by leading instructors, golf is not a sport that can be self-taught; only with good coaching and correct practice can the naturally wrong instincts be replaced with the correct fundamentals that initially feel instinctively wrong.

Finally, a deficiency with both professional lessons and self-instruction systems is a lack of a reliable means for monitoring correct "setup position" and monitoring correct balance during the entire swing. Without a way to monitor correct "setup" and "balance", most students fail to practice them correctly to develop the correct and necessary muscle-memory. Instead they develop bad muscle-memory.

U.S. Pat. No. 5,603,617 of Bergman describes a practice mat for golfers that indicates the suggested placement of the feet of a golfer and a golf ball to be hit, the proper alignment of a golf club in relation to the feet of the golfer and the golf ball, and the suggested direction of travel of the head of the golf club. The mat has a plurality of outlines in the shape of a foot to indicate the suggested foot placement based on the chosen golf club. Also, numerous rectangles are indicated on the mat for placement of the golf ball based on the chosen golf club. However, the practice mat of Bergman does not provide a means for the student to monitor and isolate any position of their body during swinging of a golf club, nor does it aid in prohibiting a golfer from introducing excessive motion sideways, up or down into their technique.

U.S. Pat. No. 5,603,617 of Light shows a sports training system having a full length mirror to reflect the image of a student and a combined television monitor and video cassette player to depict the optimal positioning and technique of a participant in the selected sports activity. Thus, a golfer could view their image in the mirror while watching a monitor below the mirror show the proper way to swing a golf club. This system does not teach proper foot positioning or proper club alignment for swinging a club, nor does it provide a means for a golf instructor to designate as such. It is also doubtful that a student of the system could view a monitor showing an ideal golf swing while observing their own swing in a full length mirror. Further, the large mirror size and lack of proper indicia would not allow the system to properly isolate a golfer's excessive motion sideways, up or down to enable correction of a flawed golf club swing. This system also lacks convenient portability.

U.S. Pat. No. 4,181,307 of Krene describes a golf training system comprising a platform on which a golfer stands, a platform upon which a golf ball placement indicating means is located, and a mirror located between the two platforms to enable the student to see their golf club swing as they hit the golf ball located on the adjacent platform. The system comprises three units that are hinged together along longitudinal edges and the mirror is swivably mounted in a frame such that the angle of tilt of the mirror can be adjusted. However, Krene does not teach a system that can be used in conjunction with golf instruction having indicating means capable of being adjusted to tailor such a system to the needs of a specific golfer. Not only are the foot placement means and ball placement means not adjustable in position or angle depending on the needs of a particular student, only the angle, and not the position of the mirror can be adjusted. Thus, depending on the student's physical size, skills, or other factors, the mirror would have no way of being properly positioned such that the student could observe the proper features of their swing to identify excessive lateral and/or vertical motion. Such a mirror in the Krene invention is also excessively large and has longitudinal lines that would be ineffective at isolating a small portion of a student's swing, again preventing the student from pinpointing excessive lateral and/or vertical motion in their swing. Further, a student of the Krene system could not accurately view a small portion of their image while focusing on a golf ball to be hit off of a platform adjacent to the mirror.

U.S. Pat. No. 2,462,955 of Glancey describes a swing practice apparatus which comprises a rigid indicative-touch-effecting arm structure that has a length substantially equal to the proper distance which should separate a golf club shaft from the top of the student's elevated shoulder at the end of the golfer's backswing. The free end of the arm structure is adapted for shoulder contact and the shaft attaching means is provided at the opposite end of the arm structure. A student using the Glancey system, however, only receives feedback at one point—the end of the backswing—while practice swinging the golf club. Another limitation to the Glancy system is that it must be attached to a stick or golf club. A third limitation of the Glancy system is that it may only be used by the individual using the golf club to which it is attached.

U.S. Pat. No. 5,316,306 of Cody comprises a golf swing training apparatus for generally improving a golfer's golf club swing technique. A rigid hand grip is connected to one end of a flexible, tubular shaft. The other end of the shaft is connected to a ball. The system has a required overall length that just fits between a vertical aligned with the outside of one arm of the golfer, the arm resting at the golfer's side, and the wrist of the golfer's other arm when the other arm and hand are jointly stretched horizontally. A threaded shaft-length adjustment connector is included at a point along the shaft for adjusting the overall length of the shaft. In use, the overall length, the flexibility of the tube, and the weight of the ball combine to result in a swing action such that on each correctly executed backswing the ball gently touches one side of the golfer just below the golfer's other arm. Likewise, on each correctly executed foreswing follow-through, the ball gently touches the other side of the golfer just below the one arm of the golfer. However, on each incorrectly executed backswing or foreswing, the ball touches the golfer either more forcefully or less forcefully than with a correctly executed swing. The golfer thus receives a tactile feedback indication of the correctness of each swing and is thus able to improve swing technique. A limitation to the Cody apparatus and method is that only the practicing golfer may use the apparatus and the feedback is only differentiable from the force of the contact of the apparatus.

As an improvement over these methods and systems for golf swing improvement, it would be desirable to have a system and method of golf instruction that would ideally be used in conjunction with proper professional golf lessons. The system would have various visual and tactile indicating means that can be adjusted by an instructor to ensure each individual student observed proper positioning form when preparing to swing a golf club and maintaining balance during the golf club swing. Such a system should also include means to allow the student to monitor and isolate a specific problem with their golf swing, namely excessive motion sideways, up or down, (i.e. lateral and vertical motion) whether in the company of an instructor or not, to ensure that proper technique is being used. A further benefit of such a system would be portability allowing the system to be used in either the location where instruction is taking place or wherever the student desires to practice their golf swing.

Thus, what is needed is a system and method for a golf instructional program to aid a golfer to develop a proper golf swing. The method and system will designate proper setup positioning and alignment for a student's feet, hands, and head, the center of the body and golf club handle position (distance from the body) and the angle of the shaft. The system further includes an instruction manual that can enable a golfer to successfully practice their golf swing frequently at any location to correctly muscle-memorize what a golf instructor taught during each of a series of lessons. The system would ideally also include a mat useful in designating proper set up positioning and alignment and golf swing balance. An arm wedge useful in practicing the first half of a golfer's backswing (i.e., the "takeaway") is also included as part of the system. A simulated golf ball may be optionally included with the system, and is placed in a position that helps the student practice the shaft angle recommended by the instructor. A mirror would also be included with the system to allow the student golfer to isolate and monitor the position of his or her head, specifically the eye position, while practicing a golf swing to ensure that head movement does not exceed the instructor's recommendations. Also vitally important to the system is the ability of a golf instructor to adjust the arm wedge, position indicators, the mirror and the simulated golf ball based upon the individual needs of the student, as the muscle flexibility of the golfer increases with practice. Further, the inclusion of a wand that either the golf instructor or another helper may hold close to different parts of the student's body to determine if the golf swing is correctly executed.

SUMMARY OF THE INVENTION

The present invention provides a system and method of golf instruction that designates proper setup positioning for swinging a golf club and allows for monitoring of balance and placement of various parts of the student's body while practicing a golf swing.

The system and method is comprised of an instructional manual that delineates the method of learning a "full swing" golf swing to be used in conjunction with professional golf lessons, together with a mat, foot and club positioning markers, a mirror, a simulated ball and club marker, an arm wedge and a wand.

The instructional manual provides specific written description of physical and mental exercises to assist a student in muscle memorizing the proper golf swing organized into a series of lessons, each lesson focusing on a different portion of the golf swing. A student is advised to learn each lesson in the order in which the action occurs in a golf swing and to practice the knowledge gained from each lesson between professional lessons. The instructional manual also allows the student to, in conjunction with the positioning markers and mirror as arranged by a golf instructor on the mat, replicate the skills learned in a golf lesson at any location the student desires. Further, the manual could be used as a tool to reinforce a proper golf club swing after the student has learned how to "muscle-memorize" or develop good habits with the system.

An important component of the system encompasses a mat that has a surface upon which a student stands and upon which specific foot and club positioning markers, as well as an attached mirror, are located. The mat is useful for students practicing the lessons set out in the instruction manual. The markers and mirror are designed to be removably attached to the mat surface to allow a golf instructor to indicate proper location and angle for the students to position themselves and the club which they are swinging. The mirror is of a chosen size such that when attached to the mat at the proper location and angle, the students can only see their eyes during the set-up and a substantial part of their golf swing if such a swing demonstrates the proper form to eliminate excessive lateral and/or vertical motion. Additionally, a centering marker and a foot wedge to be placed under a portion of the student's back foot may be removably attached to the mat surface to further pinpoint the proper setup position of the student and to aid in reducing excessive lateral motion in the student's swing. A loop and toggle system, or other similar closure system, can be provided to allow the mat to be folded and conveniently carried for transporting the mat between the location of golf instruction and another location where the student desires to practice their golf swing.

Further provided as part of the system is the arm wedge, which is useful in assisting the student to keep the forward arm and chest at a constant angle when practicing the first part of his or her backswing, the takeaway. The arm wedge is placed in such a way as to allow the student to practice the takeaway while holding the club with only one hand and the arm wedge with the other hand at the appropriate angle from the student's chest.

Also provided as part of the system is a wand suitable for a third party to check the motions of a student relative to his or her golf swing either in home practice or as part of a lesson. The wand is also useful in providing the student tactile awareness of the checked motions allowing the student to muscle memorize the correct motions more quickly.

The golf instruction system and method of the present invention work together to increase the permanency and speed of teaching and learning a fundamentally correct golf swing. The instruction manual describes and illustrates the pre-swing setup and the swing steps the instructor teaches in a series of lessons which the student practices "at-home". The "at-home" practice is ideally in slow-motion without a ball. The practice is effective with a regular length club or with an indoor short club used where swing space is limited. The lessons in the manual are organized to conform to what the instructor teaches in each of the series of instructor-conducted lessons. The lessons are also organized so the student develops good muscle-memory in stages without simultaneously developing bad muscle-memory. The mat both permits an instructor to designate customized and correct pre-swing setup positioning for the student, and permits the student to monitor the correctness of certain critical segments of the golf swing when practicing at home. The arm wedge, used as a part of the golf instruction system and method, permits an instructor and student to ensure that the angle between the student's forward arm and chest remains constant during take-away. The wand permits a third party to stand close enough to the student while holding the wand in such a way that it may or may not touch the student while the student practices his or her swing to allow tactile feedback concerning the proper execution of the golf swing without injury to the student or the instructor.

It is therefore an object of the present invention to provide a golf instructional system and method that is easily adjustable to allow the designation of proper setup positioning and balance during the golf swing depending on the needs of a particular student. It is a further object of the present invention to provide such a system that allows the student to specifically and reliably monitor excessive lateral and/or vertical motion during his or her golf club swing.

Other advantages and components of the present invention will become apparent from the following description taken in conjunction with the accompanying drawings, which constitute a part of this specification and wherein are set forth exemplary embodiments of the present invention to illustrate various objects and features thereof.

DETAILED DESCRIPTION OF THE INVENTION

Figure 1:
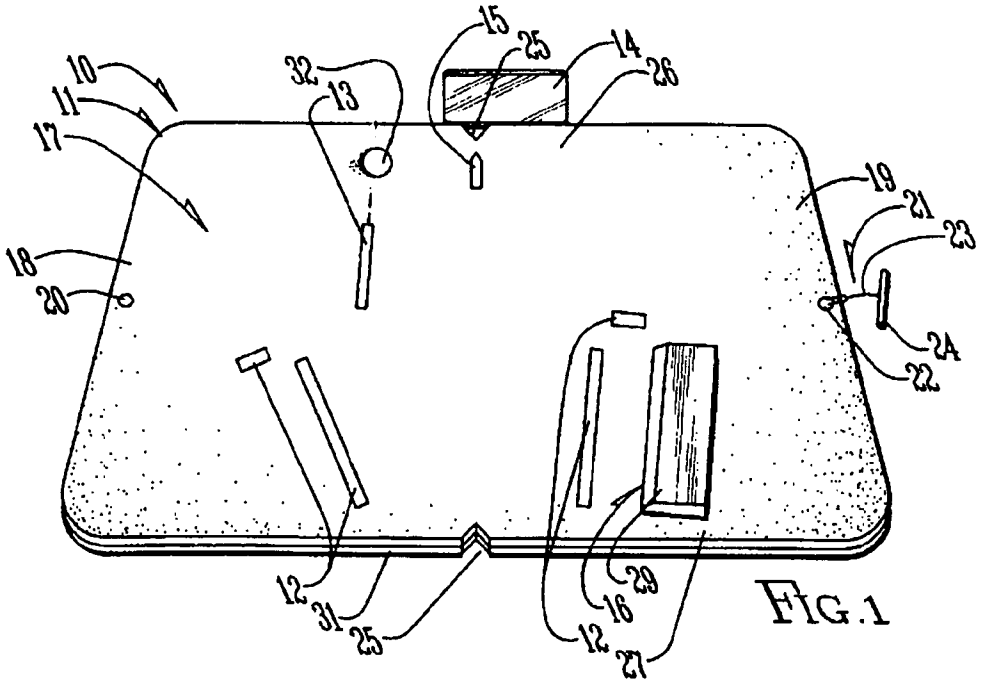
FIG. 1 is a perspective view of a golf instructional system according to the present invention.
Figure 2:
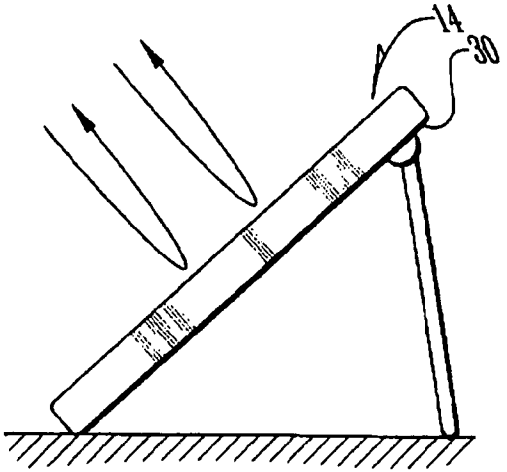
FIG. 2 is a front elevational view of the adjustable mirror for golf instructional system according to the present invention.
Figure 3:
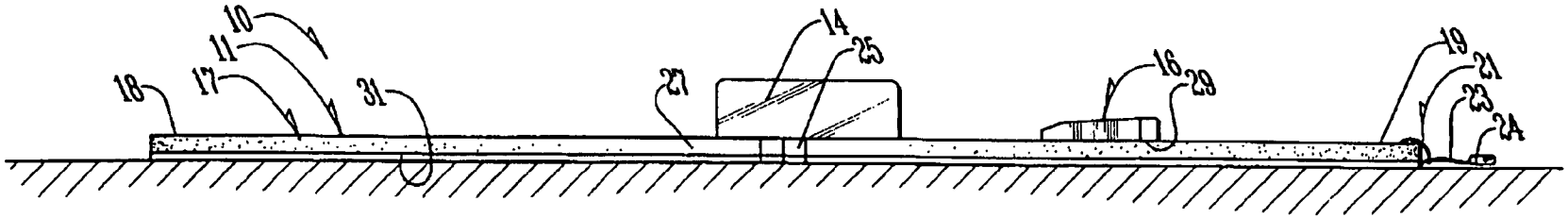
FIG. 3 is a front elevational view of the present invention.
Figure 5:
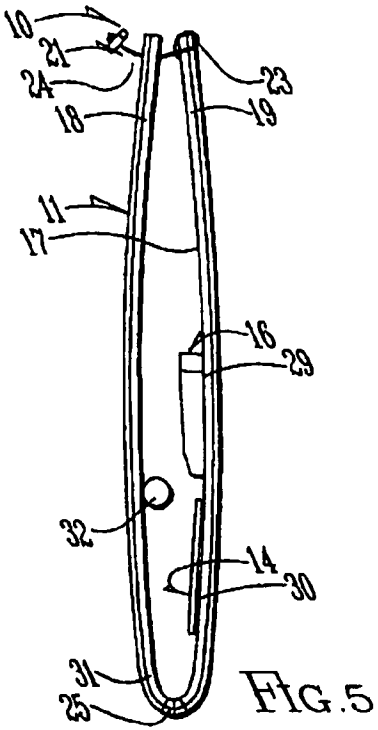
FIG. 5 is a front elevational view of the golf instructional system according to the present invention showing the mat in the folded position and secured by a closure mechanism.

Referring now to the drawings, FIG. 1 shows a golf instructional system 10 in accordance with the present invention. The instructional system 10 consists generally of an instructional manual (not shown), a support mat 11, one or more foot positioning markers 12, a club positioning marker 13, a simulated ball 32, and a mirror 14 cooperating to permit an instructor to designate the proper setup positioning for a student to practice swinging a golf club and to allow the student to monitor the location of their eyes until a simulated post-impact position is reached. In the preferred embodiment, the present invention also includes a centering marker 15 to designate a reference point for positioning the student's body on the support mat 11 and a foot wedge 16 adapted to be placed under a portion of the student's foot most rearward in the direction of the golf ball flight. Further included in the preferred embodiment the system 10 is an arm wedge 40 configured to be received between the forward-most arm (e.g. left arm for a right-handed golfer) and chest of the student and a wand 42.

The support mat 11 has a top surface 17, a bottom surface 31, a first end 18 and a second end 19, and provides a stable, yet flexible surface upon which an individual can stand to swing a golf club and upon which the other components of the present invention are securely placed. The mat 11 is of a sufficient size as to accommodate golfers of various sizes and to allow adequate room for adjustments of the positioning and monitoring components for such golfers. Typically, a mat 11 of about three feet in the length and two feet in width would be sufficient. Also, because there is no need for the mat 11 to be rigid, as the mat 11 is typically placed on a level, solid surface such as pavement, ground or floor, the mat 11 does not have to be very thick. In one embodiment, the mat 11 may have a thickness of at least ¼of an inch, preferably more. However, for the embodiment of the current invention where the mat 11 can be folded, the mat should not be so thick as to prevent it from being folded with minimal physical effort. The bottom surface 31 is preferably made from abrasion resistant materials that also have high frictional properties such that the mat 11 does not easily slide across a surface. The top surface 17 must be made of materials tat are sufficiently durable as to withstand extended use with any type shoe, including golf shoes with spikes. The top surface 17 of the mat 11 is made of a fabric material that will allow for attachment of the hook component of a hook and loop fastener system, such as that sold under the trade twine VELCRO®. In this configuration, the top surface 17 serves as the loop component of the hook and loop system. This design would allow for easy removal and readjustment of any of the components upon which the hook mechanism is secured. However, any system known in the art for removably attaching components to a support mat can also be utilized.

Figure 4:
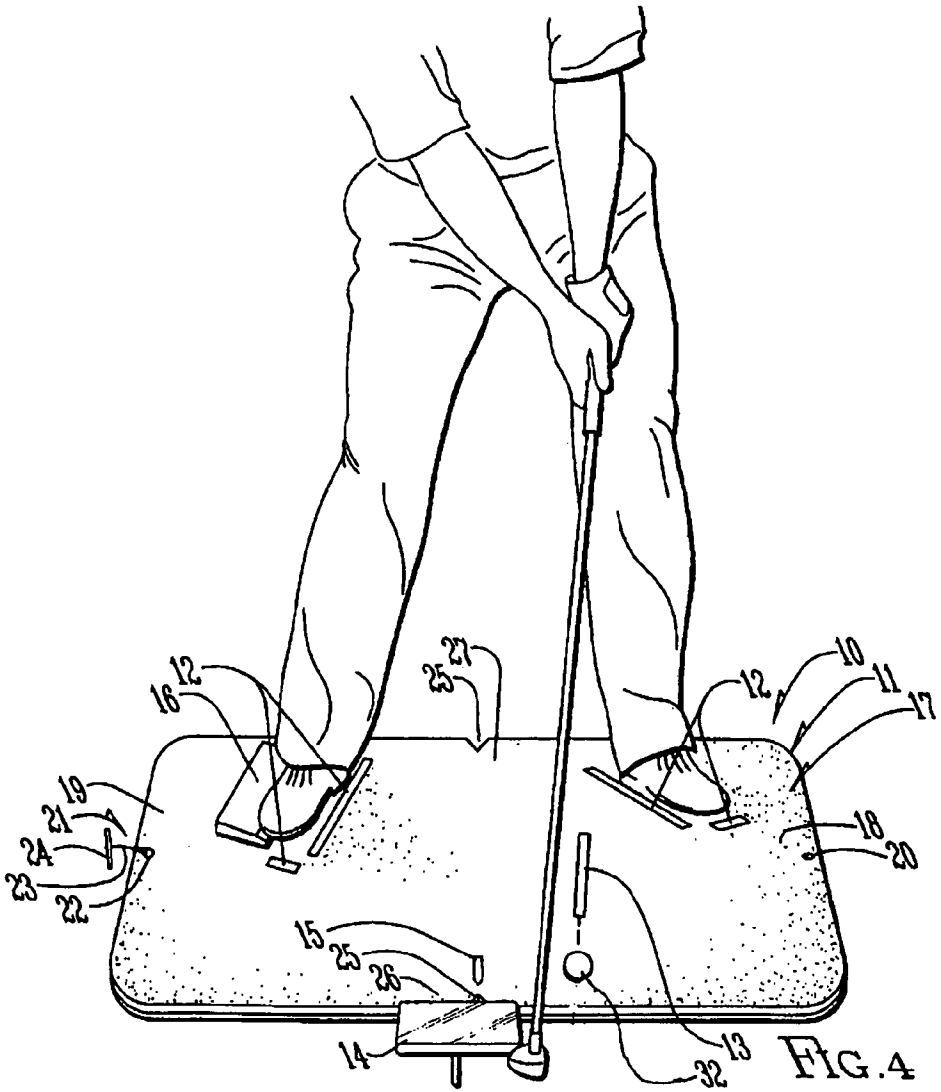
FIG. 4 is a perspective view of the golf instructional system according to the present invention showing one of the positions a right-handed golfer may assume in golf club swing training.
Figure 6:
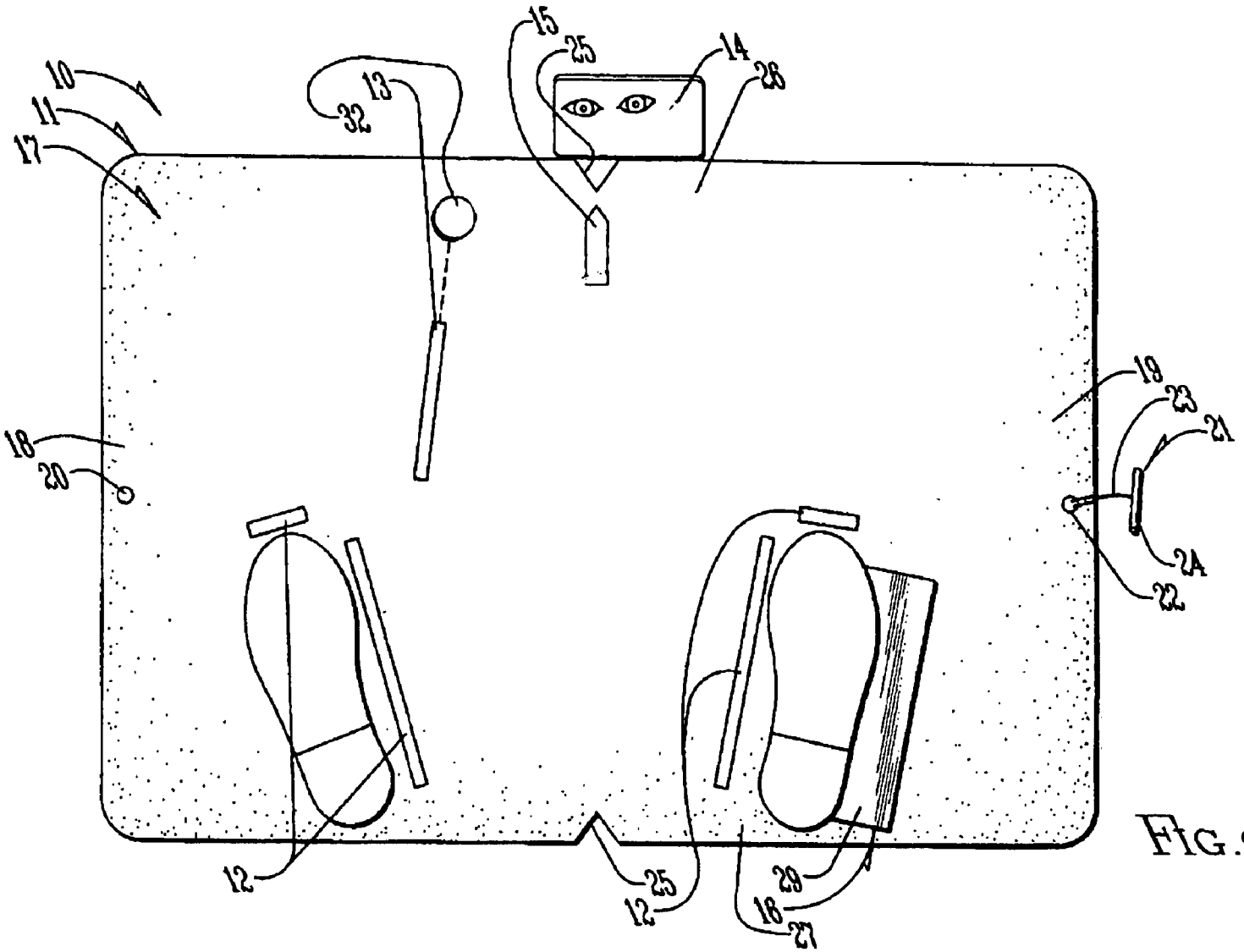
FIG. 6 is a top plan view of the golf instructional system according to the present invention showing a golfer observing his eyes in the mirror.

In the preferred embodiment of the present invention, the first end 18 of the support mat 11 has a first hole 20 for receiving a closure mechanism 21 attached to the second end 19 of the mat 11 through second hole 22. The closure mechanism 21 consists generally of a cord 23 looped through the second hole 22 and secured to a cylindrically-shaped wood toggle 24. In addition to wood, the toggle 24 may be fabricated from plastic or any other material known in the art to be sufficiently lightweight and durable for acting as a handle in carrying the instructional system 10. When the student desires to transport the instructional system 10 to another location, the support mat 11 can be folded in half such that the first and second holes 20 and 22 are substantially aligned. The student then inserts the toggle 24 through the first hole 20 to secure the mat 11 in the folded position and can use the toggle 24 as a handle for carrying the instructional system 10, as shown in FIG. 4. Although a toggle mechanism is shown, any closure mechanism for coupling the first end 18 and second end 19 of the mat 11 together to fold the mat may be used, such as a snap-type closure or fabric loop, or any method known in the art for securing two flexible ends of an object together. The flexible nature of the support mat 11 also allows for easy folding and portability of the present invention.

The foot positioning markers 12, the club positioning markers 13, and the centering marker 15 are formed from the hook component of a hook and loop fastener system, and can be removably attached to the top surface 17 of the support mat 11. The markers 12, 13 and 15 are also generally rectangular in shape, but can be of any shape or configuration known in the art to designate the proper positioning for a golfer to swing a golf club. However, any material known in the art for removably attaching components to a support mat can also be utilized for the markers. The markers can also be formed from other materials such as cloth, metal, wood or synthetics, with the hook component of a hook and loop system attached to the underside of the marker.

The centering marker 15 is generally rectangular in shape with a pointed end to designate a position on the top surface about which the student will center their body when preparing to swing a golf club. V-shaped notches 25 can be cut into the forward 26 and rearward 27 edges of the support mat 11 to serve the purpose of permanently designating a centering position for the student. However, other markers, such as studs, can be used as an alternative to the v-shaped notches 25 so long as they would securely and permanently designate the centering position for the student.

A foot positioning marker 12 is supplied for each of the student's left and/or right foot. The marker 12 is generally rectangular in shape and of a sufficient size to allow a golf instructor to designate the proper position and angle of the markers 12 for each foot based on the individual needs of the student. The angles of the feet, which are positioned according to the foot markers, can affect how far the hips can rotate, which in turn can affect the amount of body rotation and the length of the golf club's swing path. The student will align the inside of each shoe sole immediately adjacent to the respective marker 12. The marker 12 can also include right angle marks to show the proper toe placement positions of the student's foot along with the angle of alignment of the foot. The position and angle of the foot positioning markers 12 can be changed by a golf instructor as the student's flexibility increases with practice. It is possible to have a single positioning marker for either the student's left or right foot, but ideally, the positions of both feet should be designated on the mat by an instructor to assure the best setup positioning for swinging a golf club.

In the preferred embodiment of the present invention, a foot wedge 16 is placed behind the most rearward foot positioning marker 12 of the student (i.e. behind the right foot marker of a right-handed golfer or behind the left foot marker of a left-handed golfer). The foot wedge 16 is generally rectangular in shape with a sloped or rounded edge along one of its longitudinal sides and is ideally aligned with the adjacent rearward foot positioning marker 12. The wedge can be made of wood or synthetic materials that are sufficiently strong to support a portion of the weight of a student, whether applied by flat soled shoes or golf spikes. To utilize the foot wedge 16, the student will stand with at least a portion of their rearward foot on top of foot wedge 16 such that the rearward foot is aligned with the foot positioning marker 12. More specifically, the student places the outside portion of their shoe sole on the foot wedge 16.

The prime objective of the foot wedge 16 is to aid in training the golfer to maintain a near-stationary right leg during the entire backswing to enhance control over the student's "sway" in the rearward direction of swing, Additionally, maintaining a stationary right leg during the backswing generates great pressure in the right leg. When the backswing is completed, the leg pressure is relaxed and an automatic spring-back of the right leg and hips occurs at the start of the downswing. This spring-back effect helps the lower body move forward ahead of the upper body, which forces the golfer to adapt the proper form in swinging a golf club. To allow for removable attachment of the foot wedge 16 to the top surface 17 of the support mat 11, a hook component of a hook and loop fastener system can be affixed to the bottom surface 29 of the foot wedge 16 for attachment of the hook component to the mat 11. The hook component can be of any shape to sufficiently secure the foot wedge 16 to the mat 11.

The club positioning marker 13 is shaped and sufficiently sized as to allow the golf instructor to designate the proper position, angle, and alignment of the golf club shaft held by the student to setup the proper swinging of the club. This also ensures that the golfer's hands are correctly positioned in relationship to their body. A simulated golf ball 32 can also be located on the mat at a position as to designate the proper location of the golf club head before swinging the club. The simulated golf ball 32 may have a hook and loop system attached to a portion thereof. As with the foot positioning marker 12, the marker 13 is positioned by a golf instructor on the mat 11 according to certain individual characteristics of the student.

The mirror 14 is designed to allow students to view their eyes during the setup and the swing until after simulated impact with the simulated ball. To accomplish this goal, the mirror 14 is sized and configured to be sufficiently small such that when it is placed adjacent the edge of the mat 11, the student is essentially only able view their eyes if the student is in proper position as set up by the instructor. The mirror 14 is preferably rectangular in shape, but can be of any shape as to focus the student's line-of-sight on their eyes in the reflected image, such as oblong, or square. Also, the mirror 14 is preferably made of acrylic, but can be formed from any material known to provide a reflective surface. After the instructor sets the positions of the foot positioning markers 12, and the student assumes the proper setup stance on the mat 11, the location of the mirror 14 is set such that the student can view his or her eyes in the mirror. In one embodiment, a hook component of a hook and loop fastener system may be affixed to the bottom surface 30 of the mirror 14 to allow for removable attachment of the mirror to the top surface 17 of the support mat 11. During the backswing and forward swing up until after the simulated impact, the student is informed that there was no excessive head motion if their eyes can be seen in the mirror. Because the mirror 14 is sufficiently small as to isolate the eyes, the student has a simple reference point for observing excessive lateral or vertical eye motion during practice swings: if the students are unable to observe their eyes in the mirror 14 at any point until after the club head passes the position it would to hit a ball, because the eyes have moved out of the line-of-sight of the mirror reflection, then there is excessive movement. Depending on the size, ability and flexibility of the student, the mirror 14 is angled by the instructor according to the physical characteristics of the student. Also, as with the other markers 12 and 13, the angle of the mirror 14 can be changed by a golf instructor.

Figure 9:
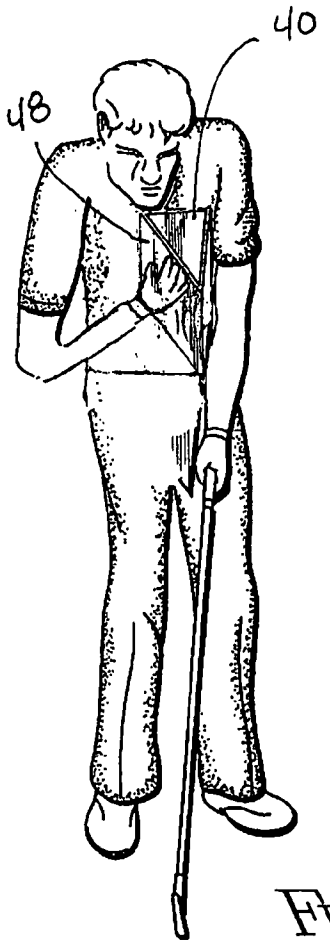
FIG. 9 is a perspective view of a wedge of the present invention.
Figure 10:
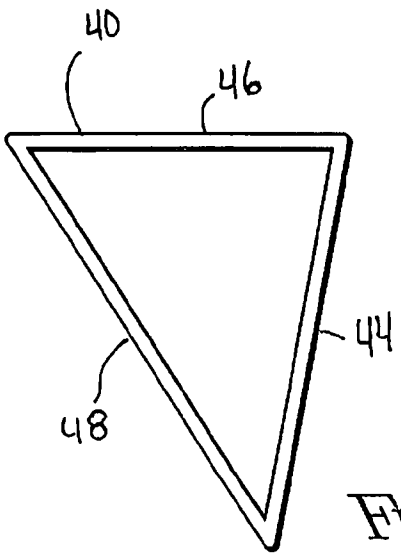
FIG. 10 is a top plan view of the arm wedge of the present invention.

With reference to FIG. 9 and FIG. 10, in one embodiment of the present invention, the arm wedge 40 may be generally triangular with a substantially planar forward-arm face 44, a chest face 46 and a hand face 48 configured to receive the hand of the student's trailing arm. So configured, arm wedge 40 is nestled between the juncture of the student's forward-most arm and chest, with the planar arm face 44 abutting the student's leading arm. The arm wedge 40 may be made of cardboard, wood or any other rigid lightweight material and of sufficient width and length such that the arm wedge 40 consistently maintains the feel of the proper angle between the student's forward most arm and chest. The arm wedge 40 may be constructed as a planar rectangle such that the three faces of the arm wedge 40 are configured by folding the rectangle along fold lines and fastening the first end to the second end preferably with a hook and loop fastener system such as VELCRO®, allowing the arm wedge 40 to be adjusted for different students and collapsed for easy storage. In another embodiment, the arm wedge 40 may be conically shaped and constructed out of rigid lightweight materials. Further, as will be readily understood by those skilled in the art, the arm wedge could be permanently formed in the triangular configuration.

To insure the arm wedge 40 remains in this position during practice, the hand face 48 is positioned at an angle between the chest and the forward-most arm to enable the student's hand of the trailing arm to hold the arm wedge 40 in position. The student can then practice the one-piece left side takeaway portion of the backswing with just the forward-most arm to muscle memorize the feel of the correct angle between the student's forward most arm and chest. Practicing the golf swing in this fashion aids in establishing muscle memory for the proper one piece left side takeaway of the backswing.

Figure 7:
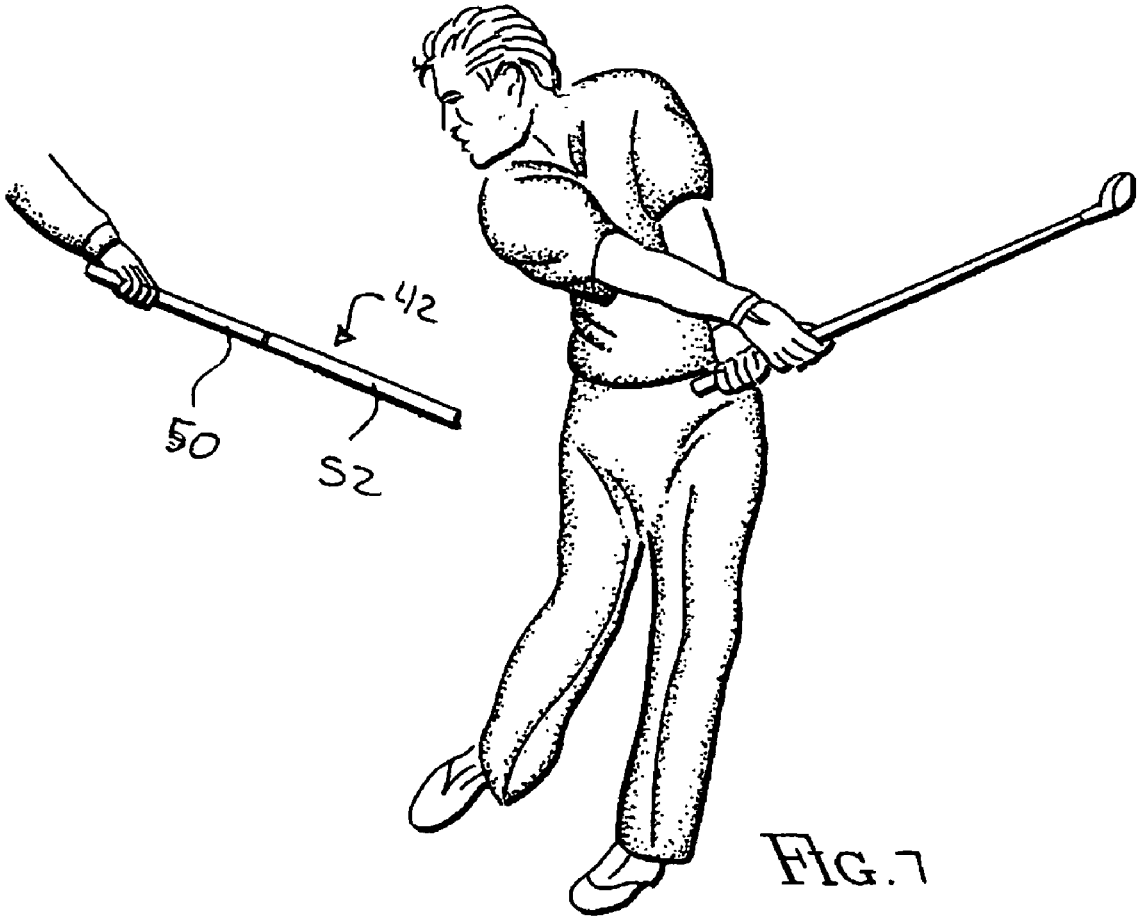
FIG. 7 is a perspective view of the wand of the present invention defining an outer boundary for a swing.
Figure 8:
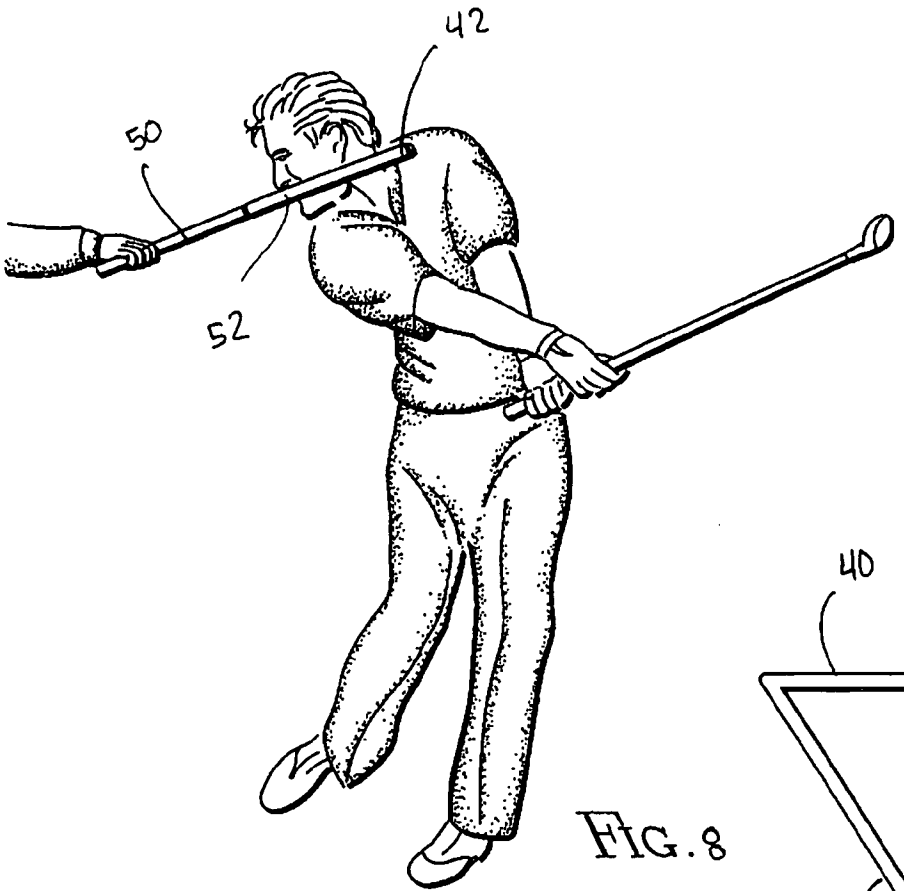
FIG. 8 is a perspective view of the wand of the present invention teaching to minimize excessive head movement during a swing.

With reference to FIG. 7 and FIG. 8, preferably the system of the present invention also includes a wand 42. The wand 42 comprises a handle portion 50 and a flexible, preferably foam end piece 52 extending longitudinally outwardly from the handle portion 50. In another embodiment, the wand 42 could be constructed solely of a flexible foam end piece possessing an aperture that could be placed over a golf club. Optimally the wand 42 is approximately twenty seven inches long, the handle portion being approximately twelve inches and the end piece being approximately fifteen inches, the length however may vary as long as the wand is of sufficient length to allow the third party to stand close to the student without being struck by the golf club while swinging. Further the end piece 52 while flexible is sufficiently solid to remain firm while held by the instructor or assistant. Optionally, the end piece is removable from the handle or is otherwise foldable allowing for easy storage. In another embodiment, the wand 42 also possesses a support attachment to the ground(not shown) useful in allowing the student to make use of the wand 42 without the assistance of a golf instructor or other third party.

Again referencing FIG. 7 and FIG. 8, during certain training exercises, a golf instructor may use the wand 42 to confirm the correctness of the positioning of one or more parts of the student's body during the golf swing. Examples of golf swing stance positions that may be confirmed or corrected by an instructor or a third person with the wand 42 include: that, during a backswing, the student's head does not move excessively either vertically or horizontally; that the student's back leg remains stationary during a backswing; that the right shoulder rotates sufficiently during the backswing; that a student's hips do not move excessively during the backswing; that the student's head does not move forward of the setup position until after impact; that the club shaft stops when it is parallel to the ground after impact; and that the student's shoulders have not rotated excessively when the club shaft is halted in the halfway up position after impact. The wand 42 may be used to define an outer boundary to ensure that the upper body and club do not move forward excessively and that the student's wrists have maintained a full wrist cock, created during the top half of the backswing, during the first half of the downswing. During the downswing, the instructor or the third person maintains the wand 42 substantially in a position that tactilely provides the outermost boundary for the motion of the student's hands during the swing allowing a student golfer to feel the necessary motion during the downswing. During the start of the downswing, the student brings his wrists and hands in a downward motion, attempting to have the wrist and hands proceed through the swing without contacting the wand 42. It is typical, however, for golfers with problem swings to allow the upper body to rotate too soon during the downswing resulting in improperly positioned shoulders, arms, hands, and club head, resulting in an improper swing path. The benefit provided by use of the wand 42 is that having an instructor or a third person hold the wand allows for direct sensory feedback for the student, allowing the student to muscle memorize the needed delay in upper body rotation. It is to be understood that any person may hold the wand with explanation from the student, and thus the student may practice the appropriate form for his or her golf swing when away from the instructor.

After the student has practiced his or her golf club swing with the golf instructional system 10 in a setting where a golf instructor has correctly positioned the components of the system, the student can take the system 10 to another location, such as at home, and in conjunction with the lessons detailed in an instructional manual (not shown), practice their swing technique outside of a formal instructional setting. The instruction manual typically takes the form of a paper notebook, but could be in any form that manuals are currently kept, or will be in the future, such as on a CD-ROM or any other media storage form, such that the teachings of the manual can be accessed by the golfer from any location and with any system, such as a bound pamphlet or book, computer, personal digital assistant, or similar electronic system. Because the position of the markers 12, 13 and 15, the mirror 14, and the foot wedge 16 on the mat 11 has been set by the instructor, and the lessons learned in the instructional setting are reiterated in the instructional manual, the student can repeat their golf swing in proper form according to the instructor's teachings and develop and muscle memorize good habits. Over a period of time, or upon advancements in technique or flexibility observed by a golf instructor, the instructor can change the position and angle of the components of the present invention to further develop the proper form of the student's golf swing. This method of instruction provides a great advantage over the prior art because the system can be arranged such that the student is required to "muscle memorize" one component of a proper club swing technique at a time, leaving no room for developing bad swing habits along with desired habits.

As mentioned above, the instructional system 10 can be used in conjunction with the instructional manual to give the student further guidance in reinforcing a specific swing or "muscle memory" technique outside of the instructional setting. It should be understood that "specific swing" refers to a customized swing prescribed by the instructor, taking into account the different physical characteristics of each student. The manual is divided into sections to correspond with what was taught during each instructional lesson. Ideally, the student learns and practices the contents of one lesson at a time in an instructional setting with a golf instructor, and the system 10, before the student uses the system 10 and instructional manual to practice alone at-home or other setting without the instructor. In this way, each individual section of the manual is not read by the student until the golf instructor directs them to do so. This ensures that the student begins to "feel" the proper swing technique when developing their swing by using the system 10 and instructional manual in conjunction with one another.

The combination of using the instructional manual with the instructional system 10 provides guidance to golf instructors on what and how to teach proper golf club swinging techniques. It is widely known in the golf industry that the teaching a correct "feel" of how to swing a golf club is very difficult and that neither demonstrations nor words can directly accomplish this goal. Providing an instructional system 10 with a set of instructions for repeating club swing techniques learned in a golf lesson facilitates the student's ability to achieve such a "feel" in their golf game.

Thus, the system 10 and instructional manual work together as follows. First, the instructor uses the mat to indicate the customized-correct pre-swing body and club positions for the student. Second, the instructor teaches the correct swing to the student in a series of lessons. These lessons include teaching the student how, and the importance of, being able to see his or her eyes in the mirror continuously until after the simulated ball has been struck. Because initially the setup position and swinging of a club as taught with the present invention feel somewhat uncomfortable and instinctively wrong to the golfer, the student must practice the setup and swing daily until everything feels comfortable and instinctively right. Most golf students are unsuccessful at developing correct setup, swing and stretching habits because (a) they forget the many important details taught by the golf instructor, and therefore practice incorrectly and develop bad muscle-memory, and (b) they can'st practice enough because of the difficulty of getting to a golf practice range. The combination of the system 10 and instructional manual make it possible for golfers to practice often enough and in correct form as to develop good muscle-memory. This is because, as the manual explains and instructs, the student can practice indoors in slow motion, without a ball. The markers on the mat and the mirror ensure that the student's setup is correct. The mirror 14 also ensures that the student learns to swing in balance, and the head doesn't move excessively until after impact. Because the manual describes and illustrates what the instructor taught during each lesson, the student remembers what was taught and is ensured of practicing correctly and developing correct muscle-memory.

From the forgoing information, it should now be obvious that the golf instructional system 10, especially when used in conjunction with the associated instructional manual, provides a training system that can be customized to meet the individual needs of a particular golfer and can more accurately monitor the required fundamentals of a good golf swing. The system 10 may be adjusted by a golf instructor to enable a golfer to improve their skills both during formal instruction and during practice sessions where the student is alone, and at any location desired. It is to be understood that the present invention can use other attachment means in addition to those disclosed herein for removably attaching certain components of the system to the support mat 11, or adjusting the size of the arm wedge 40 as future technologies may be developed to provide a similar function. Furthermore, while certain forms of the present invention have been illustrated and described herein, it is not to be limited to the specific forms or arrangement of parts described and shown.

What is claimed is:

1. A method of using a golf instructional system, said method comprising the steps of:

placing one or more foot positioning members onto a support mat surface to indicate proper placement of one or more feet of a student for swinging a golf club;

placing a club positioning member onto the support mat surface to indicate proper pre-swing body and club setup alignment;

placing a mirror adjacent to the support mat surface to indicate proper positioning of a student's eyes;

having a student stand on the support mat surface and align one or more feet with the one or more foot positioning members, position the student's body and head such that to student can essentially only view their eyes in the mirror, and swing a golf club while the student visually observes any excessive movement of their head in the mirror during at least a portion of the golf club practice swing;

providing the student with an arm wedge to indicate the proper positioning of the student's leading arm relative to the student's chest when practicing the takeaway portion of a golf swing, the arm wedge having an arm face, a chest face, and a hand face;

placing the arm wedge between the student's forward-most arm and the student's chest; and securing the arm wedge with a hand of the student's trailing arm, such that the arm face is in contact with the student's forward-most arm, the hand face is in contact with the student's trailing arm hand, and the chest face is in contact with the student's chest.

2. The method of claim 1, further comprising the step of adjusting the position of the one or more foot positioning members and the position of the club positioning member, on the support mat surface or adjacent to the mat, based on either a specific instructional lesson to be taught by a golf instructor or on changes or improvements in the setup or golf club swing of a student.

3. The method of claim 2, wherein the adjusting is performed by a golf instructor and not by the student using the support mat.

4. The method of claim 1, further comprising the step of providing the student with an instructional manual containing teaching methods corresponding to specific lessons taught by a golf instructor, such teachings arranged within the manual in a manner as to facilitate the student reinforcing specific pre-swing setup positioning and club swing techniques learned with the instructional system outside the presence of the golf instructor.

5. The method as in claim 1, further comprising the step of folding the arm wedge along fold lines.

6. A method of providing golf instruction, said method comprising the steps of:

providing a student with an instructional system having markers for designating proper setup positioning for the student to swing a golf club, the positioning being customized and markers being adjustable for an individual student;

having a golf instructor position the markers on the system in such locations as to teach the student a proper setup position for swinging a golf club;

providing the student with an arm wedge to assist the student in practicing the takeaway portion of a golf swing, the arm wedge having an arm face, a chest face, and a hand face; placing the arm wedge between the student's forward-most arm and the student's chest; and securing the arm wedge with a hand of the student's trailing arm, such that the arm face is in contact with the student's forward-most arm, the hand face is in contact with the student's trailing arm hand, and the chest face is in contact with the student's chest.

7. The method of claim 6 further comprising the steps of:

providing a mirror with the instructional system for monitoring the location of a student's eyes while making practice swings with the golf club;

having the golf instructor position the mirror on the system in such a location as to teach the student to maintain a near-steady head while making practice swings with the golf club;

providing the student with an instructional manual containing teaching methods corresponding to specific lessons taught by the golf instructor, such teachings arranged within the manual such that the student can reinforce a specific pre-swing body and position and a specific club swing technique learned with the instructional system outside the presence of the golf instructor; and having the golf instructor fold the arm wedge along fold lines to adjust the arm wedge for the student.

8. The method of claim 7 further comprising the step of providing a wand, movable by the instructor or a third party to different locations adjacent a student's body while a student swings a golf club to determine if the student's motions are correct, the wand having a flexible portion for contacting the golf club if the student's motions are not correct.

9. The method as in claim 6, further comprising the steps of:

placing the arm wedge between the student's forward-most arm and the student's chest; and securing the arm wedge with a hand of the student's trailing arm.

10. A method of providing golf instruction in which a student practices golf club swings with only the forward-most arm holding the club such that the angle between the student's forward-most arm and the student's chest remains constant during takeaway, comprising the steps of:

providing an arm wedge to a student, the arm wedge having an arm face, a chest face and hand face;

placing the arm wedge between the student's forward-most arm and the student's chest; and securing the arm wedge with a hand of the student's trailing arm, such that the arm face is in contact with the student's forward-most arm, the hand face is in contact with the student's trailing arm hand, and the chest face is in contact with the student's chest.

11. The method as in claim 10, further comprising the step of positioning a wand having a flexible portion so that the student will avoid contact with the wand when performing a proper swing motion and so that the student will obtain tactile feedback from the wand when performing an improper swing motion.

12. The method of claim 10, further comprising the steps of:

providing a wand having a flexible portion; and an instructor or a third party positioning the wand adjacent the student's body so that during a start of a correctly performed downswing the student's hands, arms, and club move under where the wand is located without contacting the wand, and so that during a start of an incorrectly performed downswing at least one of the student's hands, arms, and club contact the wand's flexible portion.

13. The method of claim 10, further comprising the steps of:

providing a wand having a flexible portion; and an instructor or a third party positioning the wand so that if the student correctly stops a golf swing upon reaching a post-impact location the club will not contact the wand, and so that if the student does not correctly stop a golf swing upon reaching a post-impact location the club will contact the wand's flexible portion.

14. A portable system of golf instruction, to be used in conjunction with professional golf lessons comprising:

a support mat;

one or more markers removably attached to the mat, suitable for a golf instructor to designate proper setup positioning and stance for the student to swing a golf club;

a mirror, removably attached adjacent to the mat, suitable for monitoring the location of a student's eyes while making a portion of a practice swing with the golf club;

an instructional manual containing teaching methods corresponding to specific lessons taught by the golf instructor, such teachings arranged within the manual such that the student can reinforce a specific setup and club swing technique learned with the instructional system outside the presence of the golf instructor;

an arm wedge suitable for maintaining the proper angle between a student's forward arm and chest suitable for a golf instructor to designate proper positioning for the student to practice the takeaway of a golf swing; and a wand having a flexible portion for providing tactile feedback to a student if a motion performed by the student is incorrect.

15. The system of claim 14 wherein the wand defines an outer boundary for the student's wrist and hand during the swinging of the golf club where the student will avoid contact with the wand during a proper golf swing and where the student or the golf club will contact the wand's flexible portion during an improper golf swing.

16. The system as in claim 14, wherein:

the arm wedge includes fold lines;

the arm wedge may be folded along the fold lines to be adjusted for a student; and a fastening system selectively maintains a selected arm wedge configuration.

17. The system as in claim 14, wherein the wand is a telescoping wand to allow the wand to be compactly stored.

18. The system of claim 14 wherein the wand defines an outer boundary for at least one item selected from the group consisting of the student's wrist the student's band, the student's hip, the student's leg, the student's head, and the student's shoulder during the swinging of the golf club where the item will avoid contact with the wand during a proper golf swing and where the item will contact the wand's flexible portion during an improper golf swing.

* * * * *

UNITED STATES PATENT AND TRADEMARK OFFICE

CERTIFICATE OF CORRECTION

PATENT NO. : 7,063,627 B2
APPLICATION NO. : 10/999134
DATED : June 20, 2006
INVENTOR(S) : Richard B. Mindlin It is certified that error appears in the above-identified patent and that said Letters Patent is hereby corrected as shown below:

Front Page: Inventor information, replace "Mission, KS" with --Shawnee Mission, KS--.

Column 5: Line 13, insert --an instructor or-- before "a thrid party".
Line 40, insert --an instructor or-- after "permits".

Column 6; Line 11, replace "a wedge" with --the arm wedge--.
Line 40, insert --or-- after "embodiment".
Line 65, replace "tat" with --that--.

Column 7: Line 3, replace "twine" with --name--.

Column 12: Line 43, replace "that to student" with --that the student--.

Column 16: Line 1, insert --,-- after "wrist".
Line 1, replace "band" with --hand--.

Signed and Sealed this

Nineteenth Day of December, 2006

JON W. DUDAS
*Director of the United States Patent and Trademark Office*